United States Patent [19]

Wankel

[11] Patent Number: 4,735,561

[45] Date of Patent: Apr. 5, 1988

[54] MACHINE HAVING PLURAL FIXED INTERNAL AXES WITH REINFORCED ROTOR

[76] Inventor: Felix Wankel, Fraunhoferstrasse 10, D-8990 Lindau, Fed. Rep. of Germany

[21] Appl. No.: 905,773

[22] Filed: Sep. 10, 1986

[30] Foreign Application Priority Data

Sep. 20, 1985 [CH] Switzerland ..... 04091/85

[51] Int. Cl.[4] ..... F01C 21/00; F01C 1/10

[52] U.S. Cl. ..... 418/83; 418/151; 418/168; 403/30

[58] Field of Search ..... 418/166, 168, 171, 151, 418/83, 270; 403/28, 30

[56] References Cited

U.S. PATENT DOCUMENTS

| | | | |
|---|---|---|---|
| 2,053,919 | 9/1936 | Pigott | 418/168 |
| 3,139,835 | 7/1964 | Wilkinson | 418/168 |
| 4,324,536 | 4/1982 | Shank | 418/270 |

*Primary Examiner*—John J. Vrablik
*Assistant Examiner*—Leonard P. Walnoha
*Attorney, Agent, or Firm*—Ladas & Parry

[57] ABSTRACT

The engagement parts of the external rotor of a machine having plural fixed internal axes are reinforced by locking screws, which extend radially outwards to the side parts of the external rotor at an acute angle parallel to the longitudinal axis of said engagement parts. The thus prevented bulging of the engagement parts due to centrifugal forces permits high rotational speeds in the case of narrow sealing gaps between the external and internal rotors and with respect to the machine casing.

17 Claims, 2 Drawing Sheets

FIG. 3
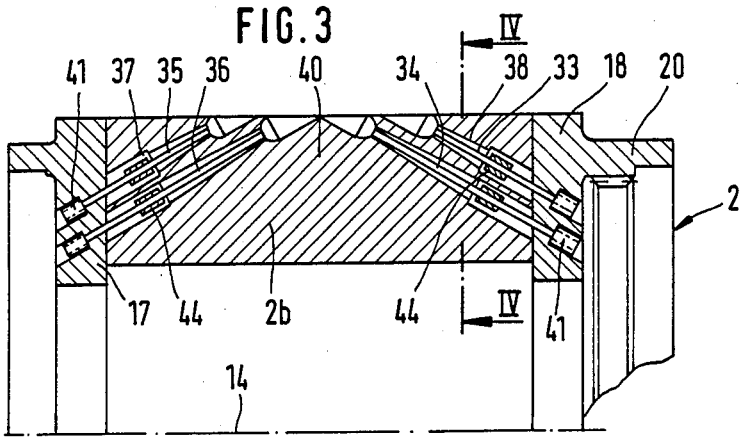
FIG. 4
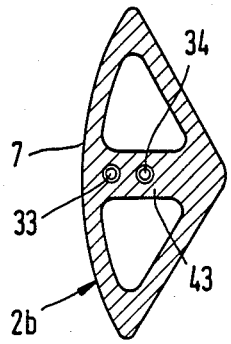
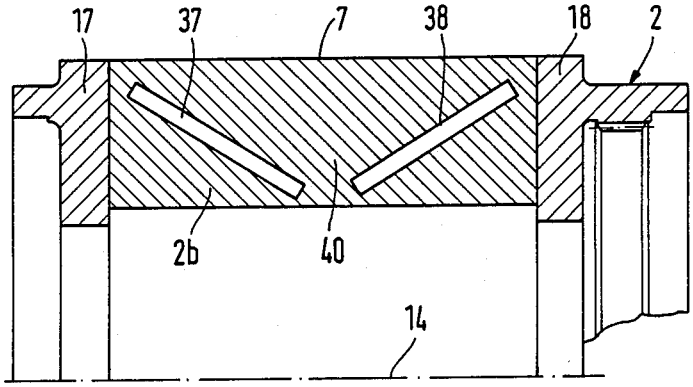
FIG. 5
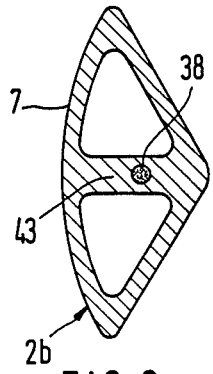
FIG. 6
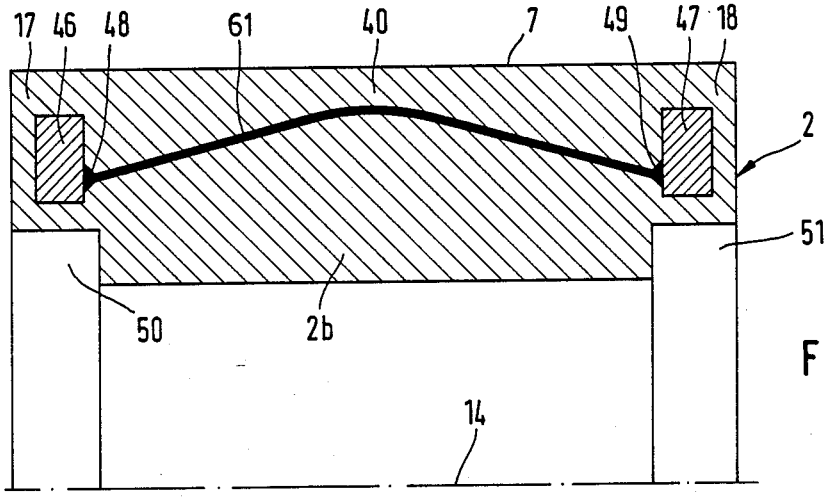
FIG. 7

MACHINE HAVING PLURAL FIXED INTERNAL AXES WITH REINFORCED ROTOR

BACKGROUND OF THE INVENTION

The present invention relates to an machine having plural fixed internal axes with an external rotor and an internal rotor, which are surrounded by a common casing provided on its circumference with an intake and outlet port, the reciprocal engagement of rotors leading to the formation of variable volume working spaces, which are sealed by gap-forming rolling and/or sliding of surface regions of the rotors on one another and on casing faces and the engagement parts of the external rotor extend in axially parallel manner between rotor side parts, over which is mounted the external rotor by means of a bearing surrounding the shaft of the internal rotor.

Apart from the advantage of the rotation of their rotors about fixed axes, machine having plural fixed internal axes have the further advantage that the external rotor can control the intake and outlet passages or ports of the machine in valve-like manner, in that the circumferential surfaces thereof move along the inner face of the casing with a limited spacing forming sealing gaps. Relatively large flow cross-sections are possible. Thus, in principle, such machines are suitable for high rotational speeds of e.g. 40,000 to 50,000 r.p.m., but as a result of the bending of the engagement parts of the external rotor, the known designs only permit an axially short machine construction and large sealing gaps which take account of shape changes, in order to prevent the external rotor running against the inner face of the casing. The throughfeed rate of the known machines is correspondingly low and wide sealing gaps lead to a poor efficiency. In addition, due to thermal expansions, shape changes have a disadvantageous effect, because account must also be taken thereof through adequately wide sealing gaps.

SUMMARY OF THE INVENTION

Therefore, with the foregoing in mind, it is a primary object of the present invention to obviate the aforementioned disadvantages and provide an machine having plural fixed internal axes which, in the case of high throughput volume and compact construction, permits high rotational speeds with narrow sealing gaps and therefore improved efficiency.

In order to implement this and still further objects of the invention, which will become apparent as the description proceeds, the invention is characterized in that at least one elongated reinforcing part is enclosed in the engagement parts of the external rotor and extends from the axially central region of the engagement parts in an acute angle to the logitudinal axis of the engagement parts in the direction of the rotor side parts.

BRIEF DESCRIPTION OF THE DRAWINGS

The invention will be better understood and objects other than those set forth above, will become apparent when consideration is given to the following detailed description thereof. Such description makes reference to the annexed drawings.

The drawings show:

FIG. 3: An axial partial cross-section through a second embodiment of an external rotor of a machine having plural fixed internal axes according to the invention.

FIG. 4: A radial section through an engagement part of the external rotor according to FIG. 3 along line IV—IV thereof.

FIG. 5: An axial partial cross-section through the external rotor of a third embodiment of a machine having plural fixed internal axes according to the invention.

FIG. 6: A radial cross-section through an engagement part of the external rotor according to FIG. 5.

FIG. 7: An axial partial cross-section through the external rotor of a fourth embodiment of a machine having plural fixed internal axes according to the invention.

FIGS. 1 and 2 show a type of machine having plural fixed intermal axes which is described in greater detail in the not previously published DE-A-3 432 915 of the same Applicant. Numerous other constructions are described in the literature. The basic construction and other embodiments can e.g. be gathered from the book entitled "Einteilung der Rotationskolbenmaschincn", 1963, Deutsche Verlags-Anstalt GmbH, Stuttgart and from "Rotary Piston Machines", London, Iliffe, 1965.

Figure 1:
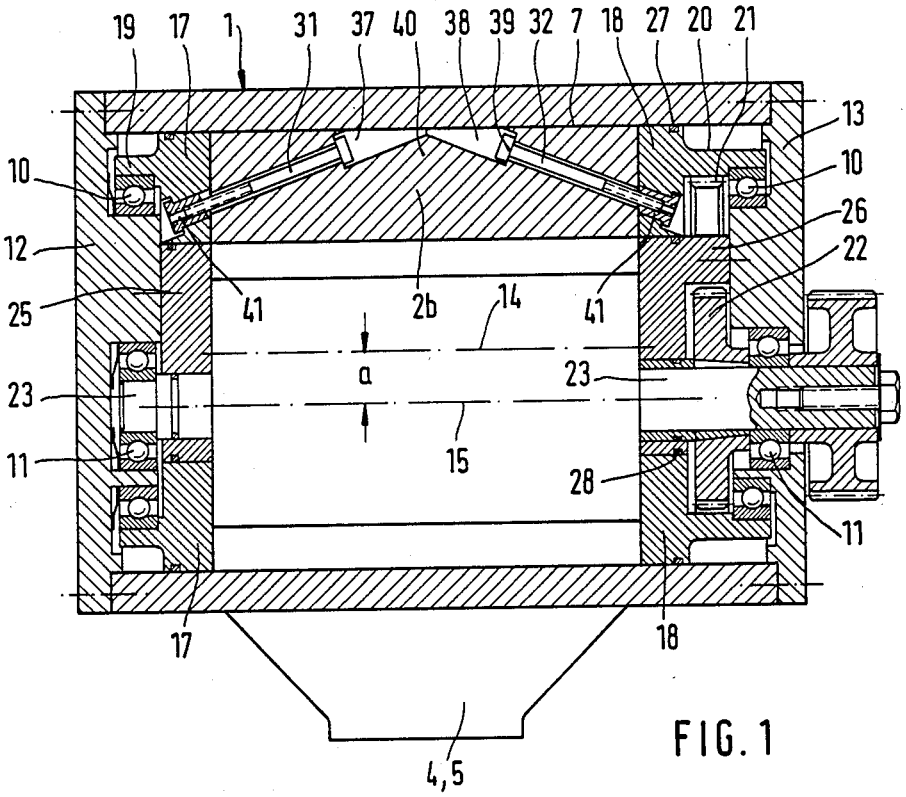
FIGS. 1 and 2: An axial and a radial section through an embodiment of an machine having plural fixed internal axes according to the invention.
Figure 2:
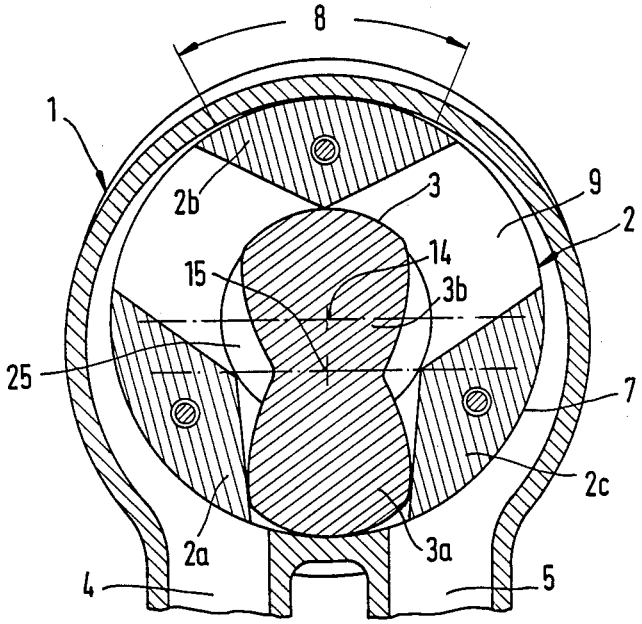

The represented machine has a speed ratio between the external rotor 2 and the internal rotor 3 of 2:3, so that on the external rotor there are three engagement parts *2a, 2b, 2c* and on the internal rotor two engagement parts *3a, 3b*. The circumference of machine casing 1 is provided with an intake passage or port 4 and an outlet passage or port 5, which are sealed with respect to one another by the external circumferential surface 7 of engagement parts *2a, 2b, 2c* passing close to the sealing gap along part 8 of the casing inner surface. It is necessary for the sealing gap extending along said surface portion 8 of casing 1 to be longer than an engagement or working space 9 between engagement parts *2a, 2b, 2c*. The machine efficiency is greatly influenced by the quality of the sealing effect along said surface portion 8 of the casing, so that a minimum sealing gap is to be sought there and obviously also between the two rotors 2, 3. As can be gathered from the following description, the present invention makes it possible to make this sealing gap much narrower without increasing the friction losses on said surface portion 8 and between rotors 2 and 3.

Rotors 2, 3 are mounted by antifriction bearings 10, 11, which bear on side plates 12, 13 of casing 1. As a result of the spacing a between the geometrical axes 14, 15, the inner antifriction bearing 11 of internal rotor 3 has a radially displaced position within the surrounding outer antifriction bearing 10 of external rotor 2. For the purposes of mounting the external rotor 2, on its side parts 17, 18 hubs 19, 20 are shaped, which enclose the antifriction bearing 10. In addition, part of one of said hubs 20 forms a hollow gear 21, which meshes with a spur gear 22, which is placed on shaft 23 of the internal rotor 3.

Side parts 17, 18 of external rotor 2 interconnect its three engagement parts *2a, 2b, 2c* and together with a sealing member 25, 26 connected in each case to one of the casing side plates 12, 13 axially seal the working spaces 9 of the machine. Correspondingly said side parts 17, 18 of external rotor 2 are shaped like circular rings, which on the radial inside and outside are in each case provided with a radial seal 27, 28. Side parts 17, 18 of the external rotor can be cast in one piece with the engagement parts *2a, 2b, 2c* or can be subsequently joined therewith, e.g. by screws or other joining means.

As can be gathered from the cross-sectional representation of the machine in FIG. 1 and the axial sections of part of an external rotor 2 according to FIGS. 3, 5 and 7, according to the invention, strand or rod-like elongated reinforcing parts 31, 32; 33 to 36; 37, 38; 39 extend from the axial central region 40 of each engagement part *2a, 2b, 2c* of the external rotor in outwardly sloping manner towards the axial ends of the external rotor 2 or its side parts 17, 18, so that they greatly reduce the bulging out of the engagement parts *2a, 2b, 2c* due to the centrifugal forces.

In accordance with the embodiments of FIGS. 1 to 4 the reinforcement parts 31, 32 or 33 to 36 comprise locking screws, which extend through sloping bores 37, 38, which pass into the side parts 17, 18. The screw head 39 is anchored on engagement part *2a, 2b, 2c* and the nut 41 belonging to the screw is anchored on side parts 17, 18 or vice versa. Locking screws 31, 32 or 33 to 36 are made from high strength steel and are under a significant initial stress, in that the lock nuts 40 are tightened with a corresponding torque. The modulus of elasticity of the locking screws is much higher than that of the material of engagement parts *2a, 2b, 2c*. The effect of the centrifugal force is to bend radially outwards the engagement parts in the central region 40 thereof, whereas the locking screws act against such bulging through being directed from said region in inwardly radially sloping manner towards the side parts. As shown by the embodiment according to FIGS. 3 and 4, it is possible to provide in each case two radially superimposed locking screws 33, 34; 35, 36, instead of in each case only one in symmetrical arrangement corresponding to FIG. 1. These locking screw pairs 33, 34; 35, 36 are provided in a central web 43 of the engagement parts *2a, 2b, 2c* constructed as a hollow body for weight reduction purposes.

As an additional variant, FIG. 3 shows the arrangement of weights 44 screwed onto the central region of the locking screws 33, 34; 35, 36 or in some other way fixed there, which under the influence of the centrifugal force bulge the locking screws and consequently increase the tensile stress thereof as a function of the rotational speed. Locking screws 31, 32; 33 to 36 can also be made from a material having a lower thermal expansion than the surrounding material of the engagement parts *2a, 2b, 2c*, so that they better counteract thermal expansions of the engagement parts.

In place of locking screws as reinforcing parts, in the embodiment according to FIGS. 5 and 6 compression members 37, 38 are provided, which are enclosed in the casting process into the material of the engagement parts *2a, 2b, 2c*. However, they also have a much higher modulus of elasticity, but as a result of their sloping arrangement from the radial outside to inside towards the central region 40, they are subject to compression and bending stress, in that they reinforce the engagement parts. In order to counteract more pronounced bulging of the engagement parts *2a, 2b, 2c* under the influence of the centrifugal force during heating, said compression members 37, 38 have a higher thermal expansion than the surrounding material of said engagement parts *2a, 2b, 2c*.

Reinforcing part 39 is also completely enclosed in the material of the particular engagement part *2a, 2b, 2c* in the embodiment according to FIG. 7. It comprises a strand extending in curved radial manner over the central region 40 of engagement part *2a, 2b, 2c*, e.g. in the form of a multifibre steel wire or some other multifibre strand material with a much higher modulus of elasticity than that of the surrounding material. As a result of the outwardly directed curved shape, reinforcing part 39 is subject to tensile stress. The tensile stresses are transferred to rings 46, 47 enclosed laterally in engagement part *2a, 2b, 2c* and to which are welded the ends 48, 49 of the curved reinforcing part 61.

In the embodiment according to FIG. 7, the engagement parts *2a, 2b, 2c* are joined in one piece to the side parts 17, 18 of external rotor 2 and enclose rings 46, 47 to which are fixed the reinforcing parts 61. Subsequently annular hub parts are fixed to said side parts and these also engage in recesses 50, 51. Instead of being made from metal, this external rotor can e.g. also be made from a plastics material or a plastics compression moulding material. Different materials can also be chosen for the reinforcing parts, in accordance with the strength requirements or for manufacturing reasons.

Due to the above-described inventive measures, no significant bulging takes place on engagement parts *2a, 2b, 2c* of external rotor 2, even in the case of high rotational speeds, so that it is possible to have narrow sealing gaps between the outer circumferential surfaces 7 of the engagement parts and the casing inner face 8 and consequently the machine efficiency is higher. The avoiding of a bulging of the engagement parts also ensures a better sealing between them and the internal rotor 3 due to invariable sealing gap widths.

I claim:

1. Machine having plural fixed internal axes with reinforced rotors, said machine comprising:

an external rotor defining at least one engagement part and side parts interconnecting said at least one engagement part, each of said engagement parts having at least one bore therein and extending axially parallel between said side parts;

an internal rotor reciprocally engaging said external rotor;

a shaft connected to said internal rotor, said shaft and said internal rotor being generally surrounded by said external rotor;

bearing means surrounding said shaft and around which is mounted said side parts of said external rotor;

a casing surrounding said external and internal rotors, said casing defining in its surface intake and outlet ports, the reciprocal engagement of said rotors leading to the formation of variable volumed working spaces which are sealed by minimal contact between said rotors and between said rotors and said casing;

at least two reinforcing parts having one end and an opposing end and a generally central section therebetween.

a weight fixed in said central region of said reinforcing parts one of each said reinforcing parts extending within one each of said bores, said bores having a greater width than said reinforcing parts and said weight so that said reinforcing parts can expand under centrifugal force, said reinforcing parts extending axially from the central region of said engagement parts in pair wise symmetrical arrangement and forming an acute angle with the longitudinal axis of said engagement part in the direction of said side parts of said rotor, said reinforcing parts further extending in an obtuse angle away from said central region of said engagement parts toward said rotor side parts wherein said reinforcing parts are under initial stress and anchored at said one end in said central region of said engagement parts and at said opposing end at said side parts, said opposing end being anchored closer to the axis of the external rotor than said one end is anchored to the axis of said central region.

2. Machine having plural fixed internal axes with reinforced rotors, said machine comprising:

an external rotor defining at least one engagement part and side parts interconnecting said at least one engagement part, each of said at least one engagement parts extending axially parallel between said said side parts.

an internal rotor reciprocally engaging said external rotor;

a shaft connected to said internal rotor, said shaft and said internal rotor being generally surrounded by said external rotor; bearing means surrounding said shaft and around which is mounted said side parts of said external rotor;

a casing surrounding said external and internal rotors, said casing defining in its surface intake and outlet ports, the reciprocal engagement of said rotors leading to the formation of variable volumed working spaces which are sealed by minimal contact between said rotors and between said rotors and said casing;

at least one reinforcing part cast into said at least one engagement part to form a union with said engagement parts, said at least one reinforcing part extending axially from the central region of said at least one engagement part in an acute angle to the longitudinal axis of said engagement part in the direction of said side parts of said rotor.

3. The machine according to claim 2, wherein said at least one reinforcing part is a compression member whose opposing end is a radially inner end and is arranged in the axially central region of said engagement parts and extends in outwardly sloping ratio manner to said side parts 4. The machine according to claim 2, wherein said at least one reinforcing part is curved radially outward and extends through said engagement part from one side part to the other side part.

5. The machine according to claim 4, further including a ring enclosed in each of said side parts and fixed to one end of said curved reinforcing part.

6. Machine having plural fixed internal axes with reinforced rotors, said machine comprising:

an external rotor defining at least one engagement part and side parts interconnecting said at least one engagement part, said engagement parts extending axially parallel between said side parts;

an internal rotor reciprocally engaging said external rotor;

a shaft connected to said internal rotor, said shaft and said internal rotor being generally surrounded by said external rotor;

bearing means surrounding said shaft and around which is mounted said side parts of said external rotor;

a casing surrounding said external and internal rotors, said casing defining in its surface intake and outlet ports, the reciprocal engagement of said rotors leading to the formation of variable volumed working spaces which are sealed by minimal contact between said rotors and between said rotors and said casing;

several reinforcing parts enclosed and radially juxtaposed with in said at least one engagement part and extending axially from the central region of said at least one engagement part in an acute angle to the longitudinal axis of said engagement part in the direction of said side parts of said rotor.

7. Machine having plural fixed internal axes with reinforced rotors, said machine comprising:

an external rotor defining at least one engagement part and side parts interconnecting said at least one engagement part, said engagement parts extending axially parallel between said side parts;

an internal rotor reciprocally engaging said external rotor;

a shaft connected to said internal rotor, said shaft and said internal rotor being generally surrounded by said external rotor;

bearing means surrounding said shaft and around which is mounted said side parts of said external rotor;

a casing surrounding said external and internal rotors, said casing defining in its surface intake and outlet ports, the reciprocal engagement of said rotors leading to the formation of variable volumed working spaces which are sealed by minimal contact between said rotors and between said rotors and said casing;

at least one reinforcing part enclosed within said at least one engagement part and extending axially from the central region of said at least one engagement part in an acute angle to the longitudinal axis of said engagement part in the direction of said side parts of said rotor, said at least one reinforcing part having a higher modulus of elasticity than the surrounding material of said engagement parts.

8. Machine having plural fixed internal axes with reinforced rotors, said machine comprising:

an external rotor defining at least one engagement part and side parts interconnecting said at least one engagement part, said engagement parts extending axially parallel between said side parts;

an internal rotor reciprocally engaging with said external rotor;

a shaft connected to said internal rotor, said shaft and said internal rotor being generally surrounded by said external rotor;

bearing means surrounding said shaft and around which is mounted said side parts of said external rotor;

a casing surrounding said external and internal rotors, said casing defining in its surface intake and outlet ports, the reciprocal engagement of said rotors leading to the formation of variable volumed working spaces which are sealed by minimal contact between said rotors and between said rotors and said casing;

at least one reinforcing part enclosed within said at least one engagement part and extending axially from the central region of said at least one engagement part in an acute angle to the longitdinal axis of said engagement part in the direction of said side parts of said rotor, said at least one reinforcing part having a different thermal expansion coefficient than that of the material of the engagement part so that upon heating said reinforcing part tends to counteract the thermal expansion of said engagement part.

9. Machine having plural fixed internal axes with reinforced rotors, said machine comprising:

an external rotor defining at least one engagement part and side parts interconnecting said at least one engagement part, said engagement parts extending axially parallel between said side parts;

an internal rotor reciprocally engaging said external rotor;

a shaft connected to said internal rotor, said shaft and said internal rotor being generally surrounded by said external rotor;

bearing means surrounding said shaft and around which is mounted said side parts of said external rotor;

a casing surrounding said external and internal rotors, said casing defining in its surface intake and outlet ports, the reciprocal engagement of said rotors leading to the formation of variable volumed working spaces which are sealed by minimal contact between said rotors and between said rotors and said casing;

at least one reinforcing part enclosed within said at least one engagement part and extending axially from the central region of said at least one engagement part in an acute angle to the longitudinal axis of said engagement part in the direction of said side parts of said rotor.

10. Machine according to claim 9, characterized in that at least two reinforcing parts (31, 32; 33, 34; 35, 36; 37, 38) extend in pairwise symmetrical arrangement and in an obtuse angle away from the central region (40) of the engagement parts (*2a, 2b, 2c*) towards the rotor side parts (17, 18).

11. Machine according to claim 10, characterized in that the reinforcing parts (31, 32; 33–36) are under initial stress and are anchored by one end (39) in the central region of an engagement part (*2a, 2b, 2c*) and by the other end (41) on a rotor side part (17, 18), the anchoring on rotor side parts (17, 18) being closer to the axis (14) of the external rotor (2) than the anchoring in the central region (40).

12. The machine according to claim 9, wherein said external rotor defines three engagement parts and wherein said internal rotor defines two engagement parts.

13. The machine according to claim 9, wherein the ratio of speed between said external rotor and said internal rotor is two to three.

14. Machine according to claim 13, characterized in that the side parts (17, 18) of external rotor (2) are joined to the engagement parts (*2a, 2b, 2c*) by the reinforcing parts (31, 32; 33–36).

15. Machine according to claim 13, characterized in that the engagement parts (*2a, 2b, 2c*) are constructed as hollow bodies, the reinforcing parts (33–36; 37, 38) extending through a central web (43) of the engagement parts.

16. Machine according to claim 15, characterized in that the reinforcing parts (31, 32; 33–36) are locking screws, which extend through bores (37, 38) in engagement parts (*2a, 2b, 2c*).

17. Machine having plural fixed internal axes with reinforced rotors, said machine comprising:

an external rotor defining at least one engagement part and side parts interconnecting said at least one engagement part, said engagement part extending axially parallel between said side parts;

an internal rotor reciprocally engaging said external rotor;

a casing surrounding said external and internal rotors, said casing defining in its surface intake and outlet ports, the reciprocal engagement of said rotors leading to the formation of variable volumed working spaces which are sealed by minimal contact between said rotors and between said rotors and said casing such that the ratio of speed between said external rotor and said internal rotor is two to three;

at least one reinforcing part enclosed within said at least one engagement part and extending axially from the central region of said at least one engagement part in an acute angle to the longitudinal axis of said engagement part in the direction of said side parts of said rotor.

* * * * *